US008196701B1

(12) United States Patent
Oliver

(10) Patent No.: US 8,196,701 B1
(45) Date of Patent: Jun. 12, 2012

(54) ACOUSTIC AND HEAT CONTROL DEVICE

(75) Inventor: Russell Oliver, Sandy, UT (US)

(73) Assignee: OS Inc., Cheyenne, WY (US)

( * ) Notice: Subject to any disclaimer, the term of this patent is extended or adjusted under 35 U.S.C. 154(b) by 0 days.

(21) Appl. No.: 13/025,973

(22) Filed: Feb. 11, 2011

Related U.S. Application Data

(60) Provisional application No. 61/303,553, filed on Feb. 11, 2010, provisional application No. 61/418,285, filed on Nov. 30, 2010.

(51) Int. Cl.
*F41A 21/00* (2006.01)

(52) U.S. Cl. ..... 181/223; 89/14.4

(58) Field of Classification Search ..... 181/223; 89/14.4
See application file for complete search history.

(56) References Cited

U.S. PATENT DOCUMENTS

| | | | | |
|---|---|---|---|---|
| 748,157 | A | 12/1903 | Bouton | |
| 822,127 | A * | 5/1906 | Hufnagel | 181/239 |
| 916,885 | A | 3/1909 | Maxim | |
| 1,427,802 | A | 9/1922 | Goodwin | |
| 1,462,158 | A | 7/1923 | Wildner | |
| 1,736,319 | A | 11/1929 | Maxim | |
| 1,773,443 | A | 8/1930 | Wilman | |
| 2,514,996 | A * | 7/1950 | Faust, Jr. | 181/223 |
| 3,667,570 | A | 6/1972 | WerBell, III | |
| 3,693,750 | A * | 9/1972 | Takkunen | 428/558 |
| 4,454,798 | A * | 6/1984 | Shea et al. | 89/14.2 |
| 4,482,027 | A * | 11/1984 | Gould | 181/223 |
| 4,501,189 | A | 2/1985 | Brandl et al. | |
| 4,510,843 | A | 4/1985 | Rabatin | |
| 4,530,417 | A * | 7/1985 | Daniel | 181/223 |
| 4,576,083 | A * | 3/1986 | Seberger, Jr. | 89/14.4 |
| 4,907,488 | A | 3/1990 | Seberger | |
| 4,974,489 | A | 12/1990 | Fishbaugh | |
| 5,010,676 | A | 4/1991 | Kennedy | |
| 5,029,512 | A | 7/1991 | Latka | |
| 5,036,747 | A | 8/1991 | McClain, III | |
| 5,078,043 | A | 1/1992 | Stephens | |
| 5,164,535 | A | 11/1992 | Leasure | |
| 5,433,133 | A | 7/1995 | La France | |
| 5,486,425 | A | 1/1996 | Seibert | |
| 5,590,484 | A | 1/1997 | Mooney et al. | |
| 5,656,166 | A * | 8/1997 | Linnersten et al. | 210/489 |

(Continued)

FOREIGN PATENT DOCUMENTS

| | | | |
|---|---|---|---|
| GB | 743111 | A | 11/1956 |

(Continued)

OTHER PUBLICATIONS

Wikipedia, Supressor, http://en.wikipedia.org/wiki/Suppressor, Retrieved Jan. 26, 2010, pp. 1-14.

(Continued)

*Primary Examiner* — Forrest M Phillips
(74) *Attorney, Agent, or Firm* — Thorpe North & Western LLP

(57) ABSTRACT

An acoustic and heat control device is disclosed and described. The device can include a central chamber oriented along a central axis within an outer shell, said central chamber having an inlet configured to receive a high energy material from a high energy outlet. Additionally, the device can include a damper disposed proximate to the central chamber and comprising an energy absorbent material. In one aspect, the device can be used with a firearm.

16 Claims, 2 Drawing Sheets

U.S. PATENT DOCUMENTS

| | | | | |
|---|---|---|---|---|
| 5,661,255 | A | 8/1997 | Webb, III | |
| 5,679,916 | A | 10/1997 | Weichert | |
| 5,698,810 | A | 12/1997 | Rose | |
| 5,777,258 | A | 7/1998 | Soon | |
| 5,860,242 | A | 1/1999 | O'Neil | |
| 5,952,625 | A | 9/1999 | Huff | |
| 6,079,311 | A | 6/2000 | O'Quinn et al. | |
| 6,298,764 | B1 | 10/2001 | Sherman et al. | |
| 6,302,009 | B1 | 10/2001 | O'Quinn et al. | |
| 6,376,565 | B1 | 4/2002 | Dyer et al. | |
| 6,425,310 | B1 * | 7/2002 | Champion | 89/14.3 |
| 6,490,822 | B1 | 12/2002 | Swan | |
| 6,499,245 | B1 | 12/2002 | Swan | |
| 6,575,074 | B1 | 6/2003 | Gaddini | |
| 6,732,628 | B1 | 5/2004 | Coburn et al. | |
| 6,792,711 | B2 | 9/2004 | Battaglia | |
| 6,796,214 | B2 * | 9/2004 | Hausken et al. | 89/14.4 |
| 6,959,509 | B2 | 11/2005 | Vais | |
| 7,000,547 | B2 | 2/2006 | Amick | |
| 7,036,259 | B2 | 5/2006 | Beretta | |
| 7,059,233 | B2 | 6/2006 | Amick | |
| 7,131,228 | B2 | 11/2006 | Hochstrate et al. | |
| 7,207,258 | B1 | 4/2007 | Scanlon | |
| 7,216,451 | B1 | 5/2007 | Troy | |
| 7,237,467 | B1 | 7/2007 | Melton | |
| 7,308,967 | B1 | 12/2007 | Hoel | |
| 7,325,474 | B2 * | 2/2008 | Yoshimura et al. | 89/14.4 |
| 7,353,740 | B1 | 4/2008 | Hoffman | |
| 7,412,917 | B2 | 8/2008 | Vais | |
| 7,587,969 | B2 | 9/2009 | Silvers | |
| 7,610,710 | B2 | 11/2009 | Brittingham | |
| 7,661,349 | B1 | 2/2010 | Brittingham | |
| 7,676,976 | B2 | 3/2010 | Dueck et al. | |
| 7,707,762 | B1 | 5/2010 | Swan | |
| 7,823,314 | B1 | 11/2010 | Wheatley | |
| 7,905,319 | B2 | 3/2011 | Sullivan | |
| 7,987,944 | B1 | 8/2011 | Brittingham et al. | |
| 2007/0107982 | A1 | 5/2007 | Sullivan | |
| 2007/0256347 | A1 | 11/2007 | Fitzpatrick et al. | |
| 2009/0235568 | A1 | 9/2009 | Auvine | |
| 2010/0048752 | A1 | 2/2010 | Vignola et al. | |
| 2010/0199834 | A1 | 8/2010 | Dueck et al. | |

FOREIGN PATENT DOCUMENTS

| | | | |
|---|---|---|---|
| GB | 2287780 | A | 9/1995 |
| GB | 2288007 | A | 10/1995 |
| WO | WO-99/02826 | | 1/1999 |

OTHER PUBLICATIONS

"JBU 6.5 inch Modular Silencer and Flash Hider System". Web. Apr. 6, 2011. http://www.airsoftatlanta.com/JBU__6__5__inch__Modular__Silencer__and __Flash__Hider__p/52319.htm.

"3.5 MSS (Modular Suppressor System)—(Barrel Extension) by JBU—Airsoft Guns | Trinity Airsoft". Web. Apr. 7, 2011. http://www.trinityairsoft.com/p-1451-35-mss-modular-suppressor-system-barrel-extension-by-jbu.aspx.

Oliver, Russell, U.S. Appl. No. 61/418,311 entitled "Coupling Device, System, and Methods to Maintain Relative Positions Between Two Components", filed Nov. 30, 2010.

Oliver, Russell, U.S. Appl. No. 13/025,954, filed Feb. 11, 2011.

Oliver, Russell, U.S. Appl. No. 13/025,989, filed Feb. 11, 2011.

Oliver, Russell, U.S. Appl. No. 13/025,941, filed Feb. 11, 2011.

U.S. Appl. No. 13/025,989, filed Feb. 11, 2011; Russell Oliver; office action mailed Sep. 30, 2011.

* cited by examiner

ACOUSTIC AND HEAT CONTROL DEVICE

RELATED APPLICATIONS

This application claims the benefit of U.S. Provisional Application No. 61/303,553, filed Feb. 11, 2010 and U.S. Provisional Application No. 61/418,285, filed Nov. 30, 2010, each of which is incorporated herein by reference.

FIELD OF THE INVENTION

The present invention relates generally to acoustic and heat control devices for firearms. Accordingly, the invention involves the field of mechanical engineering and firearms.

BACKGROUND

High energy sources can produce undesirable levels of acoustic noise and heat. When using a firearm, for example, it can be desirable to reduce acoustic noise levels because the sound produced by firing the firearm can provide information as to the location of a firearm operator. In anti-terrorism operations, concealment of the location of firearm operators is critical to hostage rescue, terrorist apprehension, operations protection, dignitary and witness protection, and intelligence gathering operations. To reduce acoustic noise levels, sound reducing devices such as sound suppressors, mufflers, and the like are commonly used. However, connection to high energy sources can cause sound reducing devices to become hot. In the case of a firearm, a hot sound suppressor can heat the atmosphere in the vicinity of the suppressor. The locally heated atmosphere can also cause optical distortion, which can interfere with sighting a target. It is desirable, therefore, to control acoustic noise levels and heat produced by a high energy source.

SUMMARY

An acoustic and heat control device is disclosed, which can be used to control or regulate acoustic noise levels and heat produced by a high energy source. The device can include a central chamber oriented along a central axis. The central chamber can have an inlet configured to receive a high energy material from a high energy outlet. The device can also include a damper disposed proximate to the central chamber. The damper can comprise an energy absorbent material.

The energy absorbent material can be selected from among a wide variety of materials and can be provided as a particulate or as a monolithic solid. Although not always required, the damper can be annular about the central chamber. Such acoustic and heat control devices for firearms can dramatically increase effectiveness and survivability of counter terrorism special forces during such operations. Increased survivability in such scenarios can improve operator performance and decrease collateral costs associated with injuries to highly trained operators.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
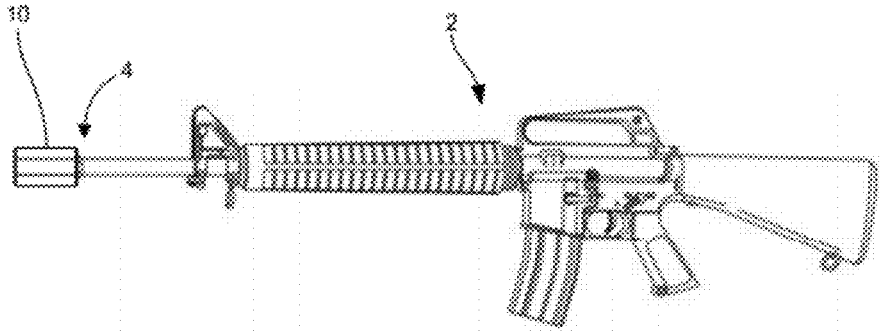
FIG. 1 is an acoustic and heat control device coupled to a firearm, in accordance with one example of the present disclosure.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a chamber" includes one or more of such chambers and reference to "an energy absorbent material" includes reference to one or more of such energy absorbent materials.

In describing and claiming the present invention, the following terminology will be used in accordance with the definitions set forth below.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, "particulate" refers to relatively small distinct solid particles which are flowable. Typically, particulate material can have a size from about 5 μm up to about 1.5 mm, although sizes outside this range may be suitable. Mesh sizes from about 80 to about 500 can be particularly suitable.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

With reference to FIG. 1, a firearm 2 is shown with an acoustic and heat control device 10. The acoustic and heat control device is coupled to a muzzle end 4 of the firearm, which is where a bullet and discharge gases exit the firearm upon firing. The acoustic and heat control device can include an energy absorbent material to transfer heat resulting from the firing of the bullet quickly away from the device into the atmosphere. A faster release of heat can reduce optical heat distortion of the atmosphere in the vicinity of the acoustic and heat control device by preventing a large accumulation of heat within the device, which can improve a firearm user's ability to accurately sight a target. This can be beneficial when many bullets are fired in a short period of time, resulting in of a high amount of heat to be released to the atmosphere. Although, in this example, the acoustic and heat control device is shown with a firearm, it should be understood that the device disclosed herein can have other applications as well, such as an engine muffler, industrial engine, or the like.

Figure 2A:
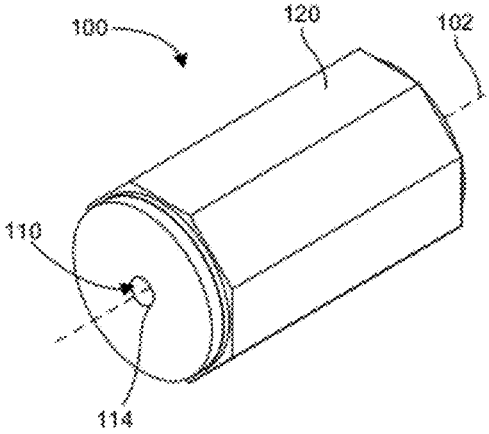
FIG. 2A is an acoustic and heat control device, in accordance with an example of the present disclosure.

FIG. 2A illustrates an acoustic and heat control device 100, in accordance with an example of the present disclosure. The device can include a central chamber 110 oriented along a central axis 102. The central chamber can have an inlet configured to receive a high energy material from a high energy outlet, such as high energy material from the firearm 2 of FIG. 1. In one aspect, the high energy material can include a bullet. As the bullet passes from the firearm barrel into the central chamber 110, acoustic waves generally follow. The bullet can be of any suitable caliber. Non-limiting examples of bullet calibers include 5.56 mm (0.223), 7.62 mm, 9 mm, 13 mm, 7.8 mm (0.308), 10.6 mm (0.416), and 12.7 mm (0.50), although projectiles from 4 mm through 40 mm outside diameter can be readily used.

Furthermore, the central chamber can include an outlet 114 along the central axis and a linear elongated path having a diameter to allow the bullet to ballistically pass through from the high energy outlet or muzzle end of the firearm. Thus, for example, the outlet has a diameter that is at least large enough to allow a bullet to pass through. This does not mean, however, that the path through the device is necessarily unobstructed. For example, a relatively soft material that is penetrable by the bullet may be located in the ballistic path of the bullet. Such a material and configuration may capture debris passing through the device and is more fully described in co-pending U.S. application Ser. No. 13/025,941, entitled "Particulate Capture from a High Energy Discharge Device," filed Feb. 11, 2011 and is incorporated herein by reference.

The acoustic and heat control device can couple to a firearm in any known manner, such as with a threaded connection. Other connections are also contemplated, such as those disclosed in U.S. Provisional Patent Application No. 61/418,311, filed Nov. 30, 2010, and entitled "Coupling Device, System, and Methods to Maintain Relative Position Between Two Components", which is incorporated by reference herein. Additionally, the acoustic and heat flow control device can be part of a modular firearm muzzle mountable device, such as disclosed in U.S. patent application No. 13/025,954, filed Feb. 11, 2011, and entitled "Interchangeable, Modular Firearm Mountable Device," which is incorporated by reference herein.

Figure 2B:
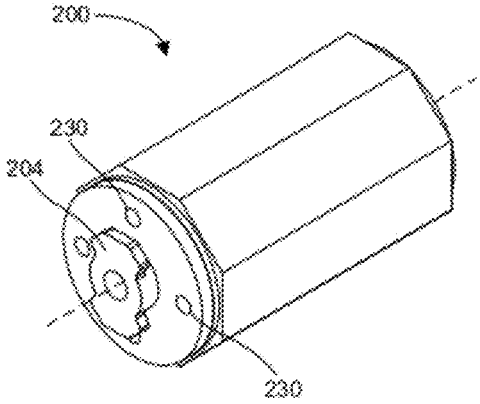
FIG. 2B is an acoustic and heat control device, in accordance with another example of the present disclosure.

FIG. 2B illustrates a coupling device 204 that can be used to couple additional components or devices to an acoustic and heat control device 200. Also shown, are outlets 230 for an off axis chamber within the device (discussed in more detail below). The outlets can vent discharge gases to the atmosphere or to another firearm muzzle attachment connected to the acoustic and heat control device 200 via coupling device 204.

With further reference to FIG. 2A, the acoustic and heat control device 100 can also include a damper 120 disposed proximate to the central chamber 110. The radial thickness and length of the damper along the central axis can vary. As a general guideline, the radial thickness can vary from about 3 mm to about 3 cm, and often from about 5 mm to about 1 cm. Similarly, as a general guideline, the length of the damper can vary from about 4 cm to about 20 cm, and often from about 8 cm to about 12 cm. These dimensions can vary depending on the particular firearm and intended use. For example, a pistol having a 5" barrel would generally use a substantially shorter length device than a 16" barrel rifle. Similarly, a sniper rifle configuration would likely use a device which has an increased length over one suitable for a close-quarters rifle configuration. The damper can comprise an energy absorbent material to transfer heat away from the device and/or dampen acoustic energy. The energy absorbent material can absorb heat from the firing of the bullet and can quickly release the heat, which reduces optical heat distortion in the vicinity of the acoustic and heat control device and improves the user's ability to accurately sight a target.

As a general guideline, materials can be chosen which provide an acoustic dampening during use. However, weight and thermal performance can also be factors in choosing materials for particular applications. For example, most often, the total weight of barrel end attachments can be limited to less than 2 lbs, and more often less than about 1.5 lbs. As such, some materials can be suitable for acoustic and thermal performance but less so for applications where weight is a significant factor. Non-limiting examples of energy absorbent materials, for example, can include powder tungsten filament, heavy metal powder, graphite, polymer beads, and combinations thereof. In one aspect, the energy absorbent material is powder tungsten filament (commercially available as Technon® Spheroidal Powder, Technon® Ultra Powder and epoxy mixture known as Technon®/Poly). In one aspect, the energy absorbent material can be in the form of particulates. When in particulate form, the device 100 can act as a significant acoustic suppressor because loose particles can vibrate and absorb energy, essentially converting a portion of acoustic energy into kinetic energy and heat. Alternatively, the energy absorbent material can be in a non-particulate form or even a combination of particulate and non-particulate forms. For example, the energy absorbent material can be provided as a solid monolithic piece which can constitute the entire damper or can be slid into a chamber as described in more detail below.

Non-limiting examples of suitable energy absorbent material can include aluminum, stainless steel, carbon steels, iron, copper, tantalum, titanium, tungsten, vanadium, chromium, zirconium, carbides of these, alloys of these, combinations thereof and the like. Other suitable materials can include iridium, silver, gold, and the like. Although not always required, the energy absorbent material can have a specific heat capacity less than about 0.40 J/gK and a thermal conductivity greater than about 1.15 W/cmK. It is noted that these properties are for the monolithic solid and actual thermal properties would change for a particulate material, although generally in the same relative performance as for the solid material. Table I presents heat capacity and thermal conductivity values for a few select materials which can be used. Thus, choosing particular materials can be a balance of these factors.

TABLE I

Energy absorbent material properties

| Material | Specific Heat Capacity ($J\ g^{-1}K^{-1}$ at 27° C.) | Thermal Conductivity ($W\ m^{-1}K^{-1}$ at 27° C.) |
|---|---|---|
| Tungsten | 0.13 | 1.74 |
| Iron | 0.44 | 0.802 |
| Copper | 0.38 | 4.01 |
| Aluminum | 0.90 | 2.37 |
| Tantalum | 0.14 | 0.575 |
| Titanium | 0.52 | 0.219 |
| Vanadium | 0.49 | 0.307 |
| Chromium | 0.45 | 0.937 |
| Zirconium | 0.27 | 0.227 |
| Iridium | 0.13 | 1.47 |
| Silver | 0.235 | 4.29 |
| Gold | 0.128 | 3.17 |
| Graphite | 0.71 | 2.2 |

In one aspect, the energy absorbent material can be any suitable acoustic impedance filter. In this case, the energy absorbent material can absorb and/or deflect acoustic waves back toward the bullet path. In one aspect, the energy absorbent material is a dry material, although fluids could be used (e.g. glycerin, ethylene glycol, iodine, linseed oil, mercury, olive oil, petroleum, water etc. and commercial proprietary heat transfer fluids such as Dowtherm® and the like can be suitable).

With reference to FIGS. 3A-3E, several different configurations of the acoustic and heat control device are illustrated. These figures represent schematic cross-sectional views of various acoustic and heat control devices that are sectioned through a central axis to illustrate several non-limiting variations in configuration which are commensurate with the broader inventive concept. The shape or geometry of the devices and elements of the devices is also not to be limited to that illustrated. Thus, for example, the devices and/or elements can be revolute about the central axis or parallel to the central axis at the cross sections shown. Additionally, features such as connectors, fasteners, threads, joints, and the like are not shown in order to simplify the figures. Such features can be integrally formed or separately attached with the devices or any component of the devices shown. Also, in the figures, cross hatching is used to indicate non-particulate energy absorbent material and dotted hatching is used to indicate particulate energy absorbent material. Unless the context dictates, the examples disclosed should not be limited to a specific type (i.e. particulate and non-particulate forms) of energy absorbent material shown in the figures.

Figure 3A:
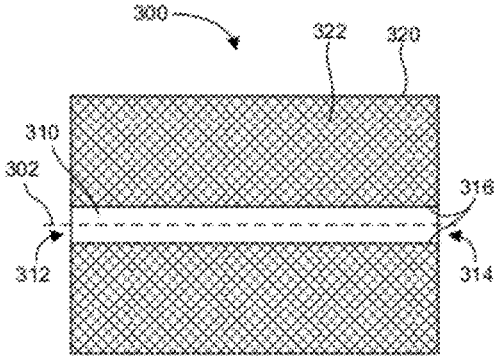
FIG. 3A is a cross-sectional schematic view of an acoustic and heat control device which is a single unitary solid in accordance with an example of the present disclosure.

FIG. 3A illustrates an acoustic and heat control device 300 having a central chamber 310 oriented along a central axis 302. The central chamber has an inlet 312 that can receive high energy material from a high energy outlet. The central chamber also has an outlet 314 where at least a portion of the high energy material can exit the device. In this example, a damper 320 comprising a single unitary structure, made of one or more monolithic energy absorbent materials, is shown. It should be noted, however, that the damper can comprise several distinct structures comprising particulate or non-particulate energy absorbent material. Such a configuration provides the energy absorbent material as a single monolithic mass, although such a mass can be segmented into multiple segments in series along the central axis 302.

This example also illustrates that the damper can form a central chamber shell 316 with the central chamber 310 being within the central chamber shell. The central chamber shell can define a ballistic path boundary through the device. As in each of FIGS. 3A-3E, the damper can be viewed as being annular about the central chamber, although this is not required. For example, the damper can vary in cross-section dimensions (i.e. flared, tapered, block, etc).

Figure 3B:
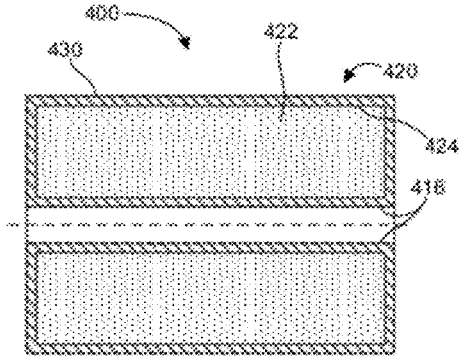
FIG. 3B is a cross-sectional schematic view of an acoustic and heat control device having a damper chamber and energy absorbent material within the chamber in accordance with another example of the present disclosure.

FIG. 3B illustrates an acoustic and heat control device 400 having a particulate energy absorbent material 422. In this example, the damper 420 comprises a dampening chamber 424 with the energy absorbent material 422 disposed within the dampening chamber. As in FIG. 3A, the device 400 of FIG. 3B illustrates damper 420 forming a central chamber shell 416, with the central chamber 410 being within the central chamber shell.

This example also includes an outer shell 430 about the device 400. As illustrated in the figure, the central chamber can be within the outer shell 430. The outer shell can be generally tubular and have any suitable cross-section shape. In one aspect, the outer shell has an octagonal cross-section as shown in FIGS. 2A and 2B. The outer shell can optionally have a circular cross-section or any other desired shape (e.g. 5, 6, 7, 9 or 10 sides) and, for example, can have non-parallel sides. In one aspect, the dampening chamber 424 can include the outer shell 430. Thus, the damper can be defined, at least in part, by the outer shell.

Figure 3C:
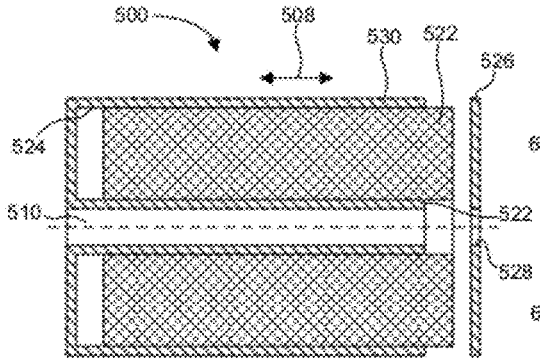
FIG. 3C is a cross-sectional schematic view of an acoustic and heat control device having a removable cap in accordance with yet another example of the present disclosure.

Acoustic and heat control device 500 of FIG. 3C, in a variation of FIG. 3B, illustrates that energy absorbent material 522 can be removed from the dampening chamber 524. An end cap 526 can be removed to gain access to the energy absorbent material. The end cap can be located at an inlet end or an outlet end and, thus, can also include an opening 528 to form an inlet or outlet for the central chamber 510. The end cap can be removably attached to outer shell 530 and/or central chamber shell 516. The end cap and energy absorbent material are shown as being removed or coupled with the device by movement generally in direction 508. This can allow for replacing of the energy absorbent material for different performance standards, damage, etc. Although the energy absorbent material is illustrated as being in a non-particulate form, it is to be understood here, as in other examples discussed herein, that the energy absorbent material can be in a particulate form.

Figure 3D:
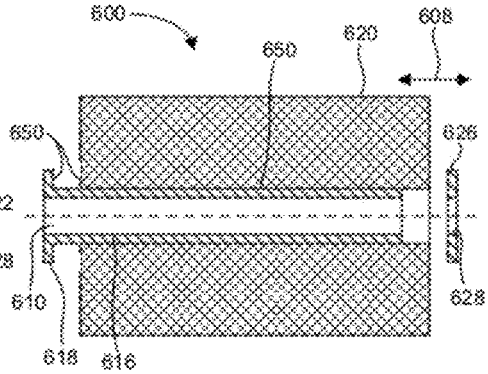
FIG. 3D is a cross-sectional schematic view of an acoustic and heat control device as a removable sleeve in accordance with still another example of the present disclosure.

In FIG. 3D, acoustic and heat control device 600 illustrates a damper 620 that is removably coupleable with central chamber shell 616. In one aspect, the damper can be configured to slide over the central chamber shell like a sleeve. End stop 618 can be disposed at one end of the device and coupled to the central chamber shell in order to locate and capture the damper. An end cap 626 can removably attach to the central chamber shell and can be used to secure the damper to the central chamber shell. The end cap can also have an opening 628 to form an inlet or outlet for the central chamber 610. The end cap and/or damper are shown as being removed or coupled with the device by movement generally in direction 608.

In another aspect, the damper 620 and central chamber shell 616 can include a connector or coupling device 650 for coupling to one another. The coupling device can be located at any interface between the central chamber shell and the damper. A coupling device can include threads, bayonet tabs, detents, springs, grooves, or any other suitable feature or component for securely coupling the damper and the central chamber shell. The damper and central chamber shell can be removably coupled by a relative rotational movement or a linear movement, alone or in any combination. Thus, the damper can couple with the central chamber shell without the end cap 626 discussed above. This can facilitate rapid coupling or decoupling of the damper and the central chamber shell. In another aspect, the coupling attributes of the end cap can be incorporated into the damper, such that the damper can couple with the central chamber shell at an inlet or outlet end of the central chamber shell.

Figure 3E:
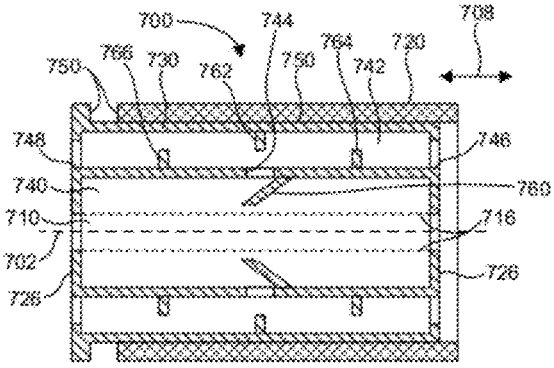
FIG. 3E is a cross-sectional schematic view of an acoustic and heat control device in accordance with a further example of the present disclosure.

With reference to FIG. 3E, acoustic and heat control device 700 illustrates an off axis chamber (i.e. inner chamber 740 and outer chamber 742) relative to central axis 702. This is a configuration that allows for suppressor, gas control, and/or other muzzle end attachments to be enveloped by the damper. As shown in the figure, off axis chambers can be within the outer shell 730. In one aspect, off axis chambers can be in fluid communication with the central chamber 710. For example, the central chamber is defined, at least in part, by boundary 717, which defines the ballistic path of a bullet through the device. The inner chamber is outside this boundary, which, in this case, is not a physical boundary. Thus, the inner chamber is in fluid communication with the central chamber. In certain aspects, the boundary between the central chamber and the inner chamber can be a physical boundary that can have an opening fluidly connecting the central chamber and the inner chamber. Optionally, the inner chamber can be fluidly isolated from the central chamber. The outer chamber, in this example, is in fluid communication with the central chamber via opening 744. Fluid communication between the central chamber and an off axis chamber, such as the inner chamber or the outer chamber, can allow discharge gases to enter the off axis chamber, which can serve to reduce pressure in the central chamber. A reduction of pressure in the central chamber can reduce acoustic noise levels.

In one aspect, the off axis chambers in this example (i.e. inner chamber 740 and outer chamber 742) can form at least a part of a firearm sound suppressor. Examples of sound suppressors that can be integrated and/or incorporated with acoustic and heat control devices of the present disclosure are disclosed in U.S. Provisional Patent Application No. 61/418,285, filed Nov. 30, 2010, and entitled "Sound Reduction Module." In certain aspects, the off axis chambers can include a baffle or flow director. For example, the inner chamber can have a baffle 760 that directs gas flow through the opening 744 and into the outer chamber. The outer chamber can include baffles 762, 764, 766 to direct gas flow in the outer chamber. Any number of baffles in any configuration can be utilized. For example, baffles can comprise multiple internal walls configured to produce an axially serpentine fluid pathway that dissipates energy transferred from a high energy material, such as discharge gases.

Optionally, the outer chamber can include an outlet 746. The outer chamber outlet can provide an escape for gases from the outer chamber, which can reduce the amount of gas that will escape the outer chamber via the opening 744 to the central chamber. In certain aspects, the outer chamber outlet can be in fluid communication with another firearm muzzle mounted device, such as a pressure regulator or flash suppressor. In this case, discharge gases can pass from the acoustic and heat control device 700, via the central chamber outlet and the outer chamber outlet, to another firearm mounted device.

In another aspect, the outer chamber 742 can optionally include an inlet 748 that can receive gases from another device or source. For example, a firearm muzzle mounted device, such as a pressure regulator or particulate capturing device, can be coupled between the acoustic and heat control device 700 and a firearm. In this case, discharge gases can pass from the firearm muzzle mounted device to the acoustic and heat control device 700 via the central chamber inlet and the outer chamber inlet. In a specific aspect, the outer shell 730 can include an end cap 726 at an inlet and/or outlet end of the central chamber 710 that can allow fluid to enter/escape from an off axis chamber, such as inlet 748 and outlet 746 of the outer chamber 742. The end cap can be optionally removable or permanent.

Additionally, FIG. 3E illustrates a damper 720 located outside the outer shell 730. In one aspect, the damper can be integrally formed about the outer shell. In another aspect, the damper can be removably couplable to the outer shell. In this case, the damper and outer shell can include a connector or coupling device 750 for coupling to one another. The damper is shown as being removed or coupled with the outer shell by movement generally in direction 708. The coupling device can be located at any interface between the outer shell and the damper. A coupling device can include threads, bayonet tabs, detents, springs, grooves, or any other suitable feature or component for securely coupling the damper and the outer shell. The damper and outer shell can be removably coupled by a relative rotational movement or a linear movement, alone or in any combination. This can facilitate rapid coupling or decoupling of the damper and the outer shell. In a specific aspect, the damper can slide over the outer shell like a sleeve. The ability to removably couple the damper can provide some flexibility in that the device may comprise a firearm sound suppressor, or other firearm mounted device, and the damper can be selectively attached or removed depending on the needs or desires of a firearm user. In one aspect, the damper can comprise a dampening chamber filled with an energy absorbent material.

The outer chamber 742 in this example is defined, at least in part, by outer shell 730. However, this need not be the case, as there may be other structure, such as a damper, that would prevent the outer chamber from being defined by the outer shell.

In certain aspects, an acoustic and heat control device can have a damper located within an off axis chamber. For example, the damper can be located anywhere within an off axis chamber including, but not limited to, adjacent an outer shell and/or adjacent the central chamber shell. In another example, the damper can be used in connection with, or form a part of, a baffle in an off axis chamber. In one aspect, the damper can be annular about the central chamber. As in other examples discussed herein, the damper can comprise a dampening chamber filled with an energy absorbent material. Thus, the energy absorbent material can be optionally introduced into any off axis chamber of the device.

Although the various components of the device can be formed of any suitable material, the dampening chamber, central chamber shell, outer shell, and/or any off axis chamber can be formed substantially of titanium or other suitably strong, lightweight material. Using a lightweight material where possible can be beneficial in a firearm application to minimize the mass at or beyond the muzzle of the firearm. Excessive mass at the muzzle can compromise the firearm's balance and, thus, can have a negative impact on shooting performance. In general, weight added to the muzzle end of a firearm should not exceed about 1.5-2 pounds. Non-limiting examples of other suitable materials can include high impact polymers, stainless steels, aluminum, molybdenum, refractory metals, super alloys, aircraft alloys, carbon steels, composites thereof, and the like. One or more of the individual components can further include optional coatings such as, but not limited to, diamond coatings, diamond-like carbon coatings, molybdenum, tungsten, tantalum, and the like can also be used. These components can be molded, cast, machined, deposited or formed in any suitable manner. Currently, machining can be particularly desirable but is not required. The thickness of chamber walls can vary, but is often from about 0.0625" to about 0.125" gauge material.

It should be recognized and understood that aspects of any of FIGS. 3A-3E can be incorporated or combined to create various acoustic and heat control devices in accordance with the present disclosure.

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. An acoustic and heat control device, comprising:

A central chamber oriented along a central axis, said central chamber having an inlet configured to receive a high energy material from a high energy outlet, wherein the high energy material is a bullet and the central chamber includes an outlet along the central axis and a linear elongated path having a diameter to allow the bullet to ballistically pass therethrough from the high energy outlet; and A damper disposed proximate to the central chamber and comprising an energy absorbent material, wherein the energy absorbent material is in the form of discrete particulates.

2. The device of claim 1, wherein the energy absorbent material is selected from the group consisting of powder tungsten filament, heavy metal powder, graphite, polymer, and combinations thereof.

3. The device of claim 1, wherein the damper is annular about the central chamber.

4. The device of claim 1, wherein the damper comprises a dampening chamber and the energy absorbent material is disposed within the dampening chamber.

5. The device of claim 4, wherein the energy absorbent material is a particulate selected from the group consisting of aluminum, stainless steel, carbon steels, iron, copper, tantalum, titanium, tungsten, vanadium, chromium, zirconium, carbides of these, alloys of these, and combinations thereof.

6. The device of claim 4, wherein the energy absorbent material is a powder tungsten filament.

7. The device of claim 4, wherein the dampening chamber is formed substantially of titanium.

8. The device of claim 1, wherein the central chamber is within an outer shell.

9. The device of claim 8, wherein the outer shell has an octagonal cross-section.

10. The device of claim 8, wherein the damper is removably coupleable with the outer shell.

11. The device of claim 8, further comprising an off axis chamber in fluid communication with the central chamber, the off axis chamber being defined, at least in part, by the outer shell.

12. The device of claim 1, further comprising an off axis chamber in fluid communication with the central chamber.

13. The device of claim 12, wherein the off axis chamber includes a fluid outlet.

14. The device of claim 1, wherein the central chamber is within a central chamber shell.

15. The device of claim 14, wherein the damper is removably coupleable with the central chamber shell.

16. The device of claim 1, wherein the bullet has a caliber selected from the group consisting of 5.56 mm (0.223), 7.62 mm, 9 mm, 13 mm, 7.8 mm (0.308), 10.6 mm (0.416), and 12.7 mm (0.50).

* * * * *